United States Patent [19]

Kofahl

[11] 4,257,751

[45] Mar. 24, 1981

[54] PNEUMATICALLY POWERED PUMP

[76] Inventor: William M. Kofahl, Rte. 2, Box 297, Licking, Mo. 65542

[21] Appl. No.: 26,288

[22] Filed: Apr. 2, 1979

[51] Int. Cl.[3] ..... F04B 43/10; F04B 45/06

[52] U.S. Cl. ..... 417/394; 417/478; 92/90

[58] Field of Search ..... 417/394, 478, 389, 383; 92/90, 93, 92

[56] References Cited

U.S. PATENT DOCUMENTS

| | | | |
|---|---|---|---|
| 1,184,371 | 5/1916 | Myers | 92/92 |
| 3,212,447 | 10/1965 | Browne | 417/394 |
| 3,253,549 | 5/1966 | Vincent et al. | 417/394 X |
| 3,317,141 | 5/1967 | Mann | 417/478 X |
| 3,429,272 | 2/1969 | Wilhite | 417/383 X |
| 3,637,330 | 1/1972 | Goeldner | 417/394 X |
| 3,963,377 | 6/1976 | Elliott et al. | 417/394 X |
| 4,008,008 | 2/1977 | Vergnet | 417/394 X |
| 4,158,530 | 6/1979 | Bernstein | 417/389 |

*Primary Examiner*—Leonard E. Smith

[57] ABSTRACT

A down hole pump (10) placed in a well bore for pumping liquid comprises a pump body (12) with a longitudinal axis adapted to be placed in the well bore and submerged in the liquid. A gas pressure conduit (28) is connected between the pump body (12) and the well surface for supplying pressurized gas to the pump body (12). An exhaust conduit (30) is connected to the pump body (12) for conducting the liquid to the well surface. A one-way valve (54) is disposed in the pump body (12) and is connected to the exhaust conduit (30). An elastic diaphragm (40) is located in the pump body (12) and is movable in response to a pressure differential between the diaphragm (40) and the pump body (12) for displacing liquid from the diaphragm (40) when the pressure in the pump body (12) is greater than that in the diaphragm (40) and for expanding with the liquid when the pressure in the pump body (12) is lower than that in the diaphragm (40). A perforated, hollow limit tube (50) is disposed about the longitudinal axis and conducts the liquid within the diaphragm (40) to the exhaust conduit (30). A piston (44) is slidably disposed in the pump body (12) and is attached to the diaphragm (40). A spring (58) is secured to the piston (44) and the pump body (12) for expanding the diaphragm from its collapsed position to its expanded position. A second one-way valve (56) is connected to the piston (44) and provides fluid communication between the diaphragm (40) and the well bore.

12 Claims, 4 Drawing Figures

PNEUMATICALLY POWERED PUMP

TECHNICAL FIELD

This invention relates to pumps for elevating fluids, and more particularly, to gas-operated diaphragm pumps.

BACKGROUND ART

A variety of pumps are in use for removing oil and other liquids from wells. The type of pump selected for use on a particular well is dictated by a number of factors, including the liquid to be pumped.

Submerged mechanical displacement pumps, operated from the surface by reciprocating sucker rods, are conventionally employed to elevate oil to the well surface. Such prior pumping systems, however, are often undesirable to the extent that they entail substantial movement of metal parts which corrode and abrade. Previously developed mechanical pumps produce a relatively limited volume of oil during each pumping cycle, and require relatively large amounts of power in operation. The close tolerances required in manufacturing the parts of such pumps also make the pumps relatively expensive to produce and maintain.

Mechanical displacement pumps normally require a large apparatus located above the ground. A sucker rod and associated machinery must be placed above the well, constituting an eyesore. In certain circumstances, mechanical displacement pumps cannot be used at all because local zoning laws prohibit placement of the large apparatus necessary for operation.

Since mechanical displacement pumps have a large number of moving parts, they are susceptible to breakdowns. These breakdowns are expensive and timeconsuming, resulting in large amounts of down time for the pump. In an oil well, such down time is costly because the well produces no revenues, yet incurs large expenses in the repair operation.

A need has thus arisen for a pump for use with oil wells which is not subject to the disadvantages noted above, but which provides improved pumping operation with reduced energy requirements.

SUMMARY OF THE INVENTION

In accordance with one aspect of the invention, a device for elevating subsurface liquids comprises a housing adapted to be placed in a well bore and submerged in the liquids. A supply conduit is connected between the housing and the surface for supplying pressurized gas to the housing. An exhaust conduit connected to the housing conducts the liquids to the well surface. An elastic diaphragm located in the housing is in fluid communication with the exhaust conduit and the well bore. The elastic diaphragm moves in response to a pressure differential between the diaphragm and the pump body to displace the liquid contained therein. A piston is slidably disposed in the housing and is attached to the diaphragm. A spring is secured between the piston and the housing for supporting and expanding the diaphragm.

In accordance with another aspect of the invention, a down hole pump for pumping liquid comprises a pump body adapted to be placed in a well bore and submerged in the liquid. A gas pressure conduit connects the pump body with the well surface and supplies pressurized gas to the pump body. An exhaust conduit connected to the pump body conducts the liquid to the well surface. An elastic diaphragm disposed in the pump body moves in response to the existence of a pressure differential between the diaphragm and the pump body for displacing liquid from the diaphragm when the pressure in the pump body is greater than that in the diaphragm, and for expanding with the liquid when the pressure in the pump body is lower than that in the diaphragm. A one-way valve is connected between the diaphragm and the exhaust conduit. A perforated, hollow limit tube is disposed about the longitudinal axis of the pump body and conducts liquid in the diaphragm to the exhaust conduit. A piston, slidably disposed in the pump body, is attached to the diaphragm. A spring is secured to the piston and the pump body for supporting the diaphragm in the pump body and for expanding the diaphragm. A second one-way valve provides fluid communication between the diaphragm and the well bore.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
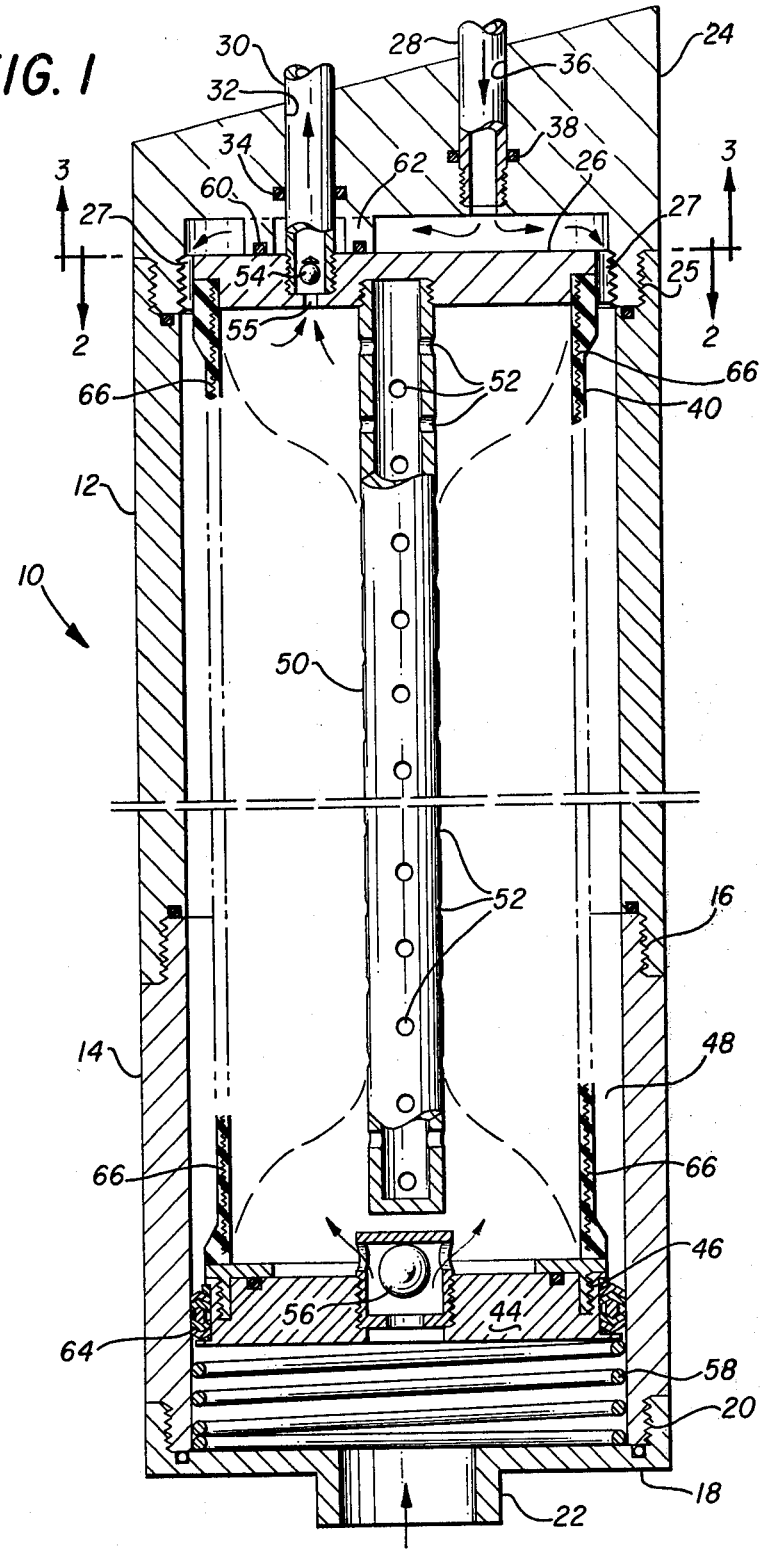
FIG. 1 is a cross sectional view of an embodiment of the invention.

Referring to FIG. 1, the pneumatically powered diaphragm pump 10 of the present invention is illustrated. The pneumatic pump 10 has a pump body 12 of generally cylindrical shape. The pump body 12 is preferably made of steel to resist corrosion and to provide strength.

The pump body 12 includes a pump head 24 which is threadedly connected to the pump body 12 at the threads 25. A sleeve head 26 with grooves 27 about its circumference threadedly connects into the pump head 24. The pump body 12 has a lower section 14 joined at the threads 16. A limiting stop 18 is connected to the lower section 14 at the threads 20. A tail pipe 22 is integrally connected to the limiting stop 18.

Two conduits 28 and 30 connect the pump 10 to the surface through the pump head 24. The exhaust conduit 30, threading into the pump head 24 at bore 32, exhausts liquid from the pump 10 to the well surface. An O-ring seal 34 fits between exhaust conduit 30 and bore 32 of pump head 24. The conduit 28, supplying pressurized gas from the well surface to the pump 10, threads into a bore 36 in the pump head 24. An O-ring seal 38 is disposed between the gas pressure conduit 28 and the pump head 24.

An oil-resistant cylindrical diaphragm 40 is disposed within the pump body 12. The cylindrical diaphragm 40 is molded into the sleeve head 26, though other methods of attaching the cylindrical diaphragm 40 to the sleeve head 26, such as threads, will be suggested to those of skill in the art. The cylindrical diaphragm 40 threads into a piston 44, disposed in the pump body 12, at the threads 46. In its fully extended position, the cylindrical diaphragm 40 almost completely fills the volume of the pump body 12. There is only a small gap 48 between the pump body 12 and the cylindrical diaphragm 40 when the cylindrical diaphragm 40 is in the extended position.

A limit tube 50 with perforations 52 thereon is attached to the sleeve head 26 and extends substantially the length of the pump body 12. The limit tube 50 is in fluid communication with the ball valve 54 through the perforations 52.

The ball valve 54, attached to the sleeve head 26 in a hole 55, is of the one-way type, and permits liquid to flow from inside the cylindrical diaphragm 40 to the exhaust conduit 30, but not in the opposite direction.

An O-ring seal 60, placed between the fitting 62 on the pump head 24 and the sleeve head 26, prevents liquid flowing from the cylindrical diaphragm 40 into the exhaust conduit 30 from entering into the gap 48 between the pump body 12 and the cylindrical diaphragm 40, and provides an airtight seal between the pump body 12, the cylindrical diaphragm 40, and the pump head 24.

A second ball valve 56 is attached to the piston 44. The ball valve 56 provides fluid communication between the interior of the cylindrical diaphragm 40 and the well bore in which the pump 10 is placed. Liquid enters the tail pipe 22, flows through the ball valve 56, and fills the cylindrical diaphragm 40. The ball valve 56 is of the one-way type, permitting liquid to enter the cylindrical diaphragm 40, but not to flow out of it.

A spring 58 is attached to the piston 44 and the pump body 12. When fully collapsed, the cylindrical diaphragm 40 elongates and moves the piston 44 toward the limit stop 18, as shown in phantom in FIG. 1, thereby compressing the spring 58. When the pressure causing the cylindrical diaphragm 40 to collapse is reduced, the spring 58 rebounds to expand the cylindrical diaphragm 40.

A chevron seal 64 forms a tight seal between the piston 44 and the lower section 14 of the pump body 12. Liquid in the well cannot enter the gap 48 between the cylindrical diaphragm 40 and the pump body 12 due to the sealing action of the chevron seal 64, nor can air in the gap 48 escape past the chevron seal 64.

Figure 2:
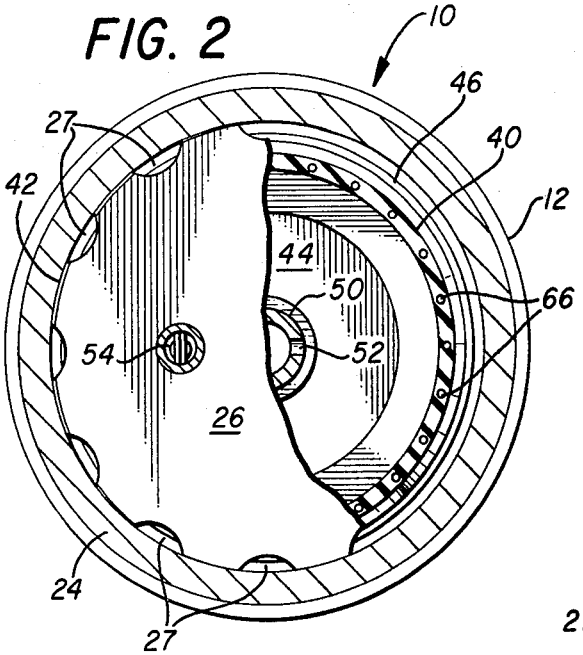
FIG. 2 is a cutaway view of the present invention taken along the line 2—2 in FIG. 1.

Referring to FIG. 2, the interior of the pump body 12 is to be seen. The limit tube 50 is centered approximately on the longitudinal axis of the pump body 12. In the fully expanded position, the cylindrical diaphragm 40 substantially fills the interior of the pump body 12, leaving only the small gap 48 between the two. When the cylindrical diaphragm 40 collapses, it conforms substantially to the outer surface of the limit tube 50. Pressurized air from conduit 28 enters the gap 48 between the pump body 12 and the cylindrical diaphragm 40 through the grooves 27 in the sleeve head 26.

Figure 3:
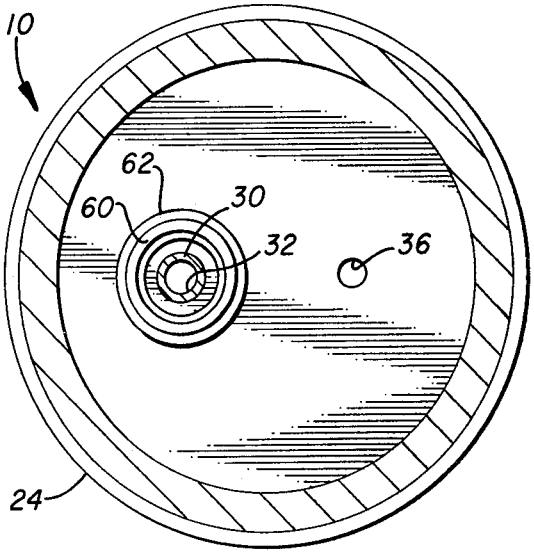
FIG. 3 is a view of the present invention taken along line 3—3 in FIG. 1.

Referring to FIG. 3, the pump head 24 is to be seen. The gas pressure conduit 28, supplying pressurized gas from the surface, enters the pump body 12 through the bore 36 in the pump head 24. The exhaust conduit 30 conducts the liquid to the surface through the bore 32 in the pump head 24. The O-ring seal 60 mates with the fitting 62 on the pump head 24 to form a tight seal between the pump head 24 and the sleeve head 26, as is hereinbefore described.

Figure 4:
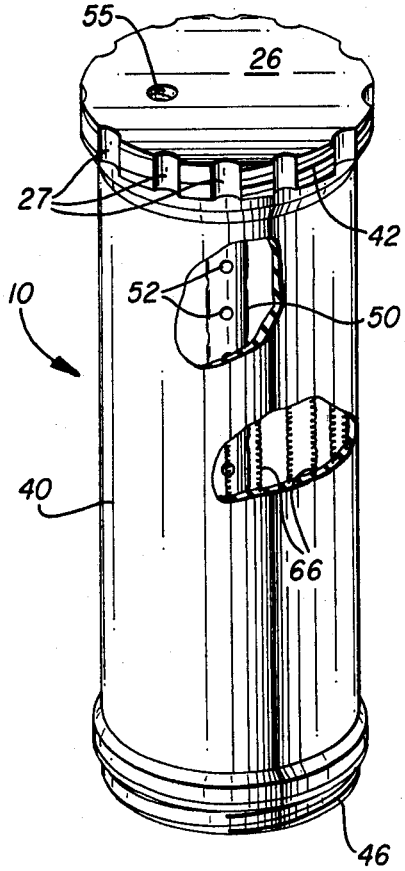
FIG. 4 is a view of the diaphragm of the present invention, with part of the diaphragm cut away to illustrate its construction.

Referring to FIG. 4, the cylindrical diaphragm 40 of the present invention is to be seen. Elastic material in the shape of a cylinder forms the walls of the cylindrical diaphragm 40. The threads 46, molded to the and of the cylindrical diaphragm 40, threadedly connect the cylindrical diaphragm 40 to the piston 44, thus providing a pressure-tight fit and maintaining the integrity of the cylindrical diaphragm 40.

Coil springs 66 are longitudinally embedded in and run along the sides of the cylindrical diaphragm 40, and extend substantially the length of the cylindrical diaphragm 40. Each coil spring 66 is in reverse order from the immediately adjacent ones, so the cylindrical diaphragm 40 will not twist when it collapses. Each coil spring 66 is approximately the same size as a violin string, and is embedded in the cylindrical diaphragm 40 in a manner similar to the cords in a vehicle tire. The coil springs 66 provide rigidity and strength to the cylindrical diaphragm 40, and aid in returning the cylindrical diaphragm 40 to its expanded position from its collapsed position.

The sleeve head 26 has threads 42 and grooves 27 on its circumference. The threads 42 threadedly connect to the pump head 24. The grooves 27 permit fluid communication between the gap 48 and the pump head 24, as is hereinbelow described. The hole 55 into which ball valve 54 threads is also illustrated in FIG. 4.

Referring to FIGS. 1–4, the operation of the pump 10 will be described. The pump 10 is lowered in a well bore and submerged in the liquid to be pumped. The pressure differential between the interior of the pump 10 and the liquid is such that the liquid will flow through the tail pipe 22 and the ball valve 56 to fill the diaphragm 40. After the cylindrical diaphragm 40 has filled, an air compressor or gas tank located on the surface (not shown) is used to supply pressurized gas through the gas pressure conduit 28. The gas flows through the gas pressure conduit 28 and the perforations 27 to fill the gap 48 between the cylindrical diaphragm 40 and the pump body 12. As the gas pressure increases, the cylindrical diaphragm 40 collapses to the shape shown in phantom in FIG. 1. As the cylindrical diaphragm 40 collapses, liquid in the cylindrical diaphragm 40 flows through the perforations 52 in the limit tube 50, the ball valve 54, and the exhaust conduit 30 to the well surface.

As the cylindrical diaphragm 40 collapses, it elongates and moves piston 44 toward the limit stop 18. The coil springs 66, embedded in the cylindrical diaphragm 40, prevent the cylindrical diaphragm 40 from twisting as it collapses and elongates.

After the cylindrical diaphragm 40 has fully collapsed to the phantom lines in FIG. 1, the gas pressure is reduced so the pressure in the well bore is greater than that in the pump body 12. Liquid in the well bore then flows through the tail pipe 22, the ball valve 56, and into the cylindrical diaphragm 40. The spring 58 attached to the piston 44 assists the expansion of the cylindrical diaphragm 40, as do the coil springs 66 longitudinally embedded in the cylindrical diaphragm 40. Liquid from the well bore fills the cylindrical diaphragm 40 until it assumes the position shown in the solid lines in FIG. 1. Air pressure is then applied through the gas pressure conduit 28 to start anew the process of pumping liquid to the well surface.

The pump 10 can be made in different sizes for different pumping jobs, as will be appreciated by those of skill in the art. In the preferred embodiment, the cylindrical diaphragm 40 will withstand ten pounds per square inch of pressure before it collapses, although other strengths of the cylindrical diaphragm 40 may be chosen for the appropriate circumstances.

Accordingly, the invention described herein has numerous advantages over prior devices. The invention requires little power to operate, as only an air compressor or other source of compressed gas is used to operate it. No large, unsightly apparatus must be located on the surface above the well bore, as the source of compressed gas need be neither large nor unsightly. The source of compressed gas does not have to be placed directly above the well bore, and can be located a distance from the well bore if need be. The present invention has fewer moving parts than previous devices, resulting in less frequent repairs, ease of repair when such repairs are required, and a reduction in the number of parts which must be produced to meet close manufacturing tolerances.

It will thus be seen that the present invention provides an improved pump with an improved pumping operation, reduced energy requirements, and more reliable operation than previous pumps.

The foregoing description of the invention is illustrative and explanatory thereof, and various changes in the size, shape, and materials as well as in the details of the illustrated construction may be made within the scope of the appended claims without departing from the scope and spirit of the invention.

I claim:

1. A device for elevating a subsurface liquid comprising:

housing means for being placed in a well bore and submerged in the liquid;

supply means connected between said housing means and the well surface for supplying pressurized gas to said housing means;

exhaust conduit means connected to said housing means for conducting the liquid to the well surface;

elastic cylindrical diaphragm means disposed in said housing means and in fluid communication with said exhaust conduit means, said diaphragm means being movable in response to pressure exerted by pressurized gas supplied by said supply means to the area between said diaphragm means and said pump body means for substantially collapsing said diaphragm means towards its axis for displacing liquid in said diaphragm means; and spring means disposed in said housing means outside said diaphragm means for expanding said diaphragm means to its expanded position after the liquid is displaced.

2. The device in claim 1 wherein:

a piston means is slidably disposed in said housing means and couples said diaphragm means to said spring means; and a plurality of coil springs are longitudinally embedded in said diaphragm means and expand said diaphragm means to its expanded position after the liquid is displaced.

3. The device in claim 1 wherein a small gap separates said diaphragm means from said housing means when the pressure in said pump body means is lower than the pressure in said diaphragm means and said diaphragm means is in an expanded position.

4. The device in claim 1 wherein said diaphragm means occupies substantially less than the volume of said pump body means when the pressure in said pump body means is greater than the pressure in said diaphragm means, and said diaphragm means is in a collapsed position.

5. The device in claim 1 and further comprising one-way valve means disposed between said diaphragm means and said exhaust conduit means.

6. The device in claim 1 and further comprising:

one-way valve means disposed between said diaphragm means and the well bore; and tail pipe means connected to said housing means for conducting the submerged liquid into said housing means.

7. The device in claim 1 and further comprising conducting means disposed about the longitudinal axis of said housing means and inside said diaphragm means, for conducting the liquid within said diaphragm means to said exhaust conduit means.

8. The device in claim 1 wherein a plurality of longitudinally placed springs are molded in said diaphragm means and expand said diaphragm means to its expanded position when the liquid is displaced.

9. A down hole pump for pumping a liquid in a well bore comprising:

pump body means for being placed in the well bore and submerged in the liquid;

gas pressure conduit means connected between said pump body means and the well surface for supplying pressurized gas to said pump body means;

exhaust means connected to said pump body means for conducting the liquid to the well surface;

elastic cylindrical diaphragm means disposed in said pump body means, said diaphragm means substantially collapsing towards its axis in response to pressure exerted by pressurized gas supplied by said gas pressure conduit means to the area between said diaphragm means and said pump body means for displacing the liquid from said diaphragm means when the pressure in said pump body means is greater than that in said diaphragm means and for expanding to fill substantially said pump body means when filling with the liquid when the pressure in said pump body means is lower than that in said diaphragm means;

first one-way valve means connected between said diaphragm means and said exhaust means for permitting the fluid to flow only out of said diaphragm means;

perforated, hollow limit tube means having a length less than said pump body means for conducting liquid in said diaphragm means to said exhaust conduit means;

piston means slidably disposed in said pump body means, supporting said diaphragm means and having an aperture therein providing fluid communication between said diaphragm means and the well bore;

spring means secured to said piston means and said pump body means for supporting and expanding said diaphragm means after the liquid is pumped; and second one-way valve means attached to said piston means and permitting the liquid in the well bore to flow only into said diaphragm means.

10. The pump in claim 9 wherein a plurality of longitudinally placed coil springs are embedded in said diaphragm means and expand said diaphragm means to its expanded position when the liquid is displaced.

11. The pump in claim 9 and further comprising a cylindrical tail pipe means connected to said pump body means for conducting liquid into said diaphragm means.

12. The pump in claim 9 wherein said perforated hollow limit tube means is disposed about the longitudinal axis of said pump body means.

* * * * *